United States Patent [19]

Brede et al.

[11] 4,269,120

[45] May 26, 1981

[54] IGNITER ELEMENT WITH A BOOSTER CHARGE

[75] Inventors: Uwe Brede; Horst Penner, both of Furth; Erich Zeiher, Furth-Vach, all of Fed. Rep. of Germany

[73] Assignee: Dynamit Nobel Aktiengesellschaft, Troisdorf, Fed. Rep. of Germany

[21] Appl. No.: 965,052

[22] Filed: Nov. 30, 1978

[30] Foreign Application Priority Data

Dec. 2, 1977 [DE] Fed. Rep. of Germany ..... 2753721

[51] Int. Cl.[3] ..... F42C 19/08

[52] U.S. Cl. ..... 102/202; 102/200

[58] Field of Search ..... 102/200, 202

[56] References Cited

U.S. PATENT DOCUMENTS

| | | | |
|---|---|---|---|
| 2,872,870 | 2/1959 | Gey | 102/202 |
| 2,939,393 | 6/1960 | Johnson | 102/202 |
| 3,011,441 | 12/1961 | Gordon | 102/202 |

FOREIGN PATENT DOCUMENTS

| | | | |
|---|---|---|---|
| 2204823 | 12/1973 | Fed. Rep. of Germany | 102/202 |

*Primary Examiner*—Donald P. Walsh

*Attorney, Agent, or Firm*—Craig & Antonelli

[57] ABSTRACT

An igniter unit for igniting of propellant charges comprises an igniter element operatively associated with a booster charge. The igniter element is arranged within an external housing and the booster charge is provided in an internal housing arranged within the external housing. The internal housing has a closed, lateral wall and a closed base at one end which withstands the ignition pressure generated upon ignition of the igniter element and the booster charge. The internal housing is provided with means for defining openings for causing the cloud of gas produced by ignition to flow from the booster charge and the igniter element to one end, that is the front end, of the internal housing to effect the ignition of the propellant charge.

14 Claims, 6 Drawing Figures

IGNITER ELEMENT WITH A BOOSTER CHARGE

The invention relates to an igniter unit for igniting of a propellant charge, the unit having an igniter element operatively associated with a booster charge arranged within an internal housing so that ignition delays are avoided.

Igniter elements with booster charges are employed for igniting propellant charges of all kinds, e.g. for rockets, propellant cases or expulsion charges; for igniting pyrotechnical mixtures, e.g. for compressed gas generators or pyrotechnical articles; or for igniting similar devices. However, these igniter elements are especially useful for the igniting of the propellant charges of ammunition for firearms and, in this context, are called propellant charge igniters.

The propellant charge igniters used for igniting the propellant powder charge in cartridges, cases, or the like have geometrical dimensions of a few millimeters to a few centimeters in diameter and in length. In rather large calibers, generally starting with about 20 mm., propellant charge igniters are utilized which preferably are threaded into the propellant charge case. An essential feature of these propellant charge igniters, also called threaded primers, is the spatial separation between the igniter element, which can be mechanically or electrically triggered and which initiates the pyrotechnical operation of the threaded primer, and a booster charge, which as a second mixture of material causes the actual ignition process, i.e. the ignition of the propellant powder charge. The booster charge, also named ignition mixture, is placed in a cylindrical internal housing which is inserted into a cylindrical external housing together with the igniter element axially in tandem.

In these known propellant charge igniters, the booster charge is arranged between the igniter element and the propellant powder charge in such a way that the ignition of the booster charge occurs from behind—as seen in the direction of gas flow—but the propellant powder charge is ignited from the front end of the booster charge. Such propellant charge igniters are described, for example, in DOS [German Unexamined Laid-Open Application] 2,504,906 and in DOS 2,504,907. Also, embodiments are known in which the igniter flame laterally emerges from the propellant charge igniter in the area of the booster charge. In both cases, the flame of the igniter element must first fully ignite the booster charge or pass through said booster charge before the propellant powder charge can be ignited, which may lead to ignition delays. Because of the necessary permeability to gas, the booster charge can be only loosely heaped or lightly compressed.

Rapid burning of the booster charge, desirable for the purpose of attaining brief ignition delay periods, can only occur upon tamping, wherein this tamping is represented in the conventional propellant charge igniters by sealing elements which burst at specific pressures. For example, the front base, averted from the igniter element and facing the propellant charge, of the internal housing, which contains the booster charge, can be formed as such a bursting sealing element in that this base is formed with safety notches, which have a star-shaped arrangement and which rip open at a predetermined ignition pressure. In so doing, unburned particles of the booster charge ignited from the rear end of the charge can pass through openings resulting at the front end; these particles only burn inside of the propellant powder charge and then burn uncontrollably. Even unignited, cold particles can be hurled forwardly out. Furthermore, the possibility exists that such particles clog up the openings occurring in the tamping. All of these processes proceed in a fully undefined manner and result in irregular ignition phenomena. Thus, the ignition behavior is not reproducible in the desired manner.

Further, the only loosely heaped or slightly compressed booster charge is sensitive to vibrations, because the size of the grains of the booster charge is decreased uncontrollably by abrasion and in that way secondarily undesired changes of the burning behavior can occur.

It is an object of the invention to avoid the aforementioned disadvantages by providing an igniter having an igniter element with a booster charge unit arranged to promote more uniform ignition, i.e. especially to form this igniter unit in such a way that the described, disadvantageous consequences of using a bursting sealing element are avoided with minimum expenditure and satisfactory operation, even under unfavorable conditions. For the purpose of attaining a reproducible ignition behavior, it is especially important to prevent portions of the booster charge from being undefinably hurled out.

According to the invention this problem is solved by construction of the internal housing for containing the booster charge without bursting sealing elements on its front end or in the area of its lateral, preferably cylindrical, wall so that after igniting the booster charge at its rear end with the aid of the igniter element, the cloud of gas produced by the ignition flows off solely through at least one opening provided therefor in the vicinity of the rear end of the internal housing and the cloud of gas is led by way of a discharge duct to the front end of the external housing and thus the cloud of gas is guided to the propellant charge to be ignited. Since, according to the invention, the cloud of gas resulting from ignition flows off at the end of the booster charge facing the igniter element which is to be ignited, the flame of the igniter element advantageously does not need to first fully ignite the booster charge or pass through the booster charge in order to be able then to ignite the propellant charge. In this way undesirable ignition delays are avoided. In addition, in this manner the danger of the undefined hurling out of unburned particles of the booster charge is eliminated.

The tamping of the booster charge is formed by the flow resistance of the at least one opening in the area of the rear end of the internal housing and of the at least one discharge duct connected to this opening. The inside cross-section of the opening and of the discharge duct as well as the length and shape of this discharge duct are, correspondingly, to be defined so that the flowing off of the cloud of gas produced by the ignition is choked in such a way that the booster charge is reacted under the gas pressure which is optimal in the respective individual case. The booster charge can be placed in the e.g. cup-shaped cavity of the internal housing in such a way and this internal housing can be formed in such a way that the booster charge directly contacts the igniter element, which booster charge is preferably provided with a cover, which is destructible or combustible at ignition and which is made of paper, metal foil, powder foil, or the like. Preferably the rear end of said booster charge, i.e. its combustible composition side and its firing side, is, however, located at a spacing from the igniter element so that from the beginning a free chamber is provided between both said rear end and the igniter element. This chamber acts as a primary combustion chamber which is tamped toward the outside, i.e. toward the propellant charge, by the opening or by the discharge duct. In this primary combustion chamber results a severe vorticity of the cloud of gas produced by ignition and thus results in uniform burning or ignition of the combustible particles or a heating of the possibly provided incombustible particles of the booster charge. These phenomena proceed in a reproducible manner so that even with a relatively short discharge duct, the cloud of gas produced by ignition emerging from the front end of said discharge duct contains no particles which are still cold. Thus, the cloud of gas resulting from ignition is a mixture of gas and burning or glowing particles. In accordance with the requirements of the individual case, the portion of these particles can be adjusted by the size and shape of the primary combustion chamber and by the tamping in the form of flow cross-sections for the cloud of gas resulting from ignition. Especially, the ignition and burning of the particles is controlled in such a way that no more unburned particles emerge from the external housing end, which end is on the side of the propellant charge.

Since the end, facing the propellant charge, of the internal housing has a base which withstands the ignition pressure, the cloud of gas produced by ignition is necessarily dissipated in the stated manner. The at least one discharge opening in the area of the rear end of the internal housing and the discharge duct associated with the discharge opening represent flow hindrances or baffle plates, which cause the advantageous deflection of the cloud of gas produced by ignition. Owing to the embodiment according to the invention, it is further very advantageously possible to insert the booster charge in pressed form, because it cannot be forwardly hurled out as a plug or in the form of fragments—as would be the case in the conventional propellant charge igniters. Since the burning rate is dependent on the compacting, there is thus the possibility of additionally influencing the temporal reaction of the booster charge according to the requirements of the individual case.

The internal housing can be connected to the external housing fixedly, for instance along the lines of a press fit or by cementing. However, it is preferably detachably joined to the external housing, for example by threading or along the lines of a bayonet connection. The at least one lateral opening in the vicinity of the rear end of the internal housing connects the rearwardly open inner chamber of said internal housing, which chamber contains the booster charge, with the at least one discharge duct; this opening is preferably formed in the internal housing in that this internal housing is provided with at least one cutout, proceeding from its rear, annular front surface, having a shape like a square, triangle, semicircle, or the like. But this opening could also be formed in the external housing, for example, in that said external housing is provided with a radial, groove-like recess which connects the rear end of the inner chamber of the internal housing with the rear end of the discharge duct.

Various embodiments are possible for the at least one discharge duct according to the invention, which duct connects the opening in the area of the rear end of the internal housing to the front end, on the propellant charge side, of the external housing. For instance, the discharge duct can be formed as a cylindrical annular duct between the internal and external housings by the suitable selection of the diameters of the preferably cylindrical internal housing and external housing; this annular duct is connected to the inner chamber of the internal housing via radial openings in the internal housing and/or the external housing. However, in an expedient embodiment of the invention it is provided to form the discharge ducts in the form of recesses in the external and/or internal housing or as recesses formed between the external and internal housings. For this purpose, the internal housing and/or the external housing with suitably thick walls can be provided, for example, with axial bores, the rear ends of which are again joined, for instance, via radial openings to the inner chamber of the internal housing. But the discharge ducts are preferably formed by recesses between the two housings, so that the discharge ducts are constituted by wall sections of the two housings. In this manner, at slight manufacturing expense, a small structural size of the external housing is achieved, in which external housing the internal housing is reliably supported in a radial direction, so that the forces occurring during transportation, handling, etc. and even those occurring during the triggering of operation are satisfactorily absorbed.

Preferably, several discharge ducts uniformly distributed over the periphery of the internal housing and/or the internal periphery of the external housing are provided. These discharge ducts preferably extend in an axial direction. One opening in the area of the rear end of the internal housing is associated with each of the discharge ducts. These openings are preferably formed as radial, groove-like cutouts which proceed from the annular front face of the rearwardly open internal housing. In this connection, the internal housing is supported rearwardly with this front surface on a corresponding section of the external housing. The cutouts connect the primary combustion chamber to the discharge ducts. The number, shape, and dimensions of the discharge ducts and openings as well as the size of the primary combustion chamber are selected in such a way that the cloud of gas produced by ignition flowing out at the front end of the internal housing and/or the external housing is choked just intensely enough that said cloud of gas has the reproducible composition required in the respective individual case.

A deflection of the cloud of gas produced by ignition is caused with the aid of the openings and the discharge ducts. The turbulences occurring during this process cause an additional increase in pressure in the internal housing, because a contraction of the flow of the cloud of gas produced by ignition results due to the turbulence so that the effective discharge flow cross-section is smaller than the geometrical cross-section of the openings or of the discharge ducts. Besides, in that way an attenuation of the pressure process during combustion is achieved, i.e. undesirable pressure surges are avoided. The gas temperature can be controlled by the dimensioning of the discharge flow cross-sections and of the primary combustion chamber, and different courses of the ignition process can be adjusted while the same booster charge is employed. Furthermore, it is possible, while maintaining the dimensions of the structure according to the invention, to use differently combined booster charges and/or to change the compacting of these booster charges. This is especially advantageous when the igniter elements according to the invention are used for experimental purposes, e.g. for examining ignition processes, but also for controlling the burning rate and thus the temporal conversion of the booster charge. This igniter element, variable according to the invention, with a booster charge results in a considerable decrease in the expenditure in adaptations to other ignition conditions.

A further advantage of the invention resides in being able to change the flow velocity and the composition of the gas-particle mixture by additional, simple, mechanical measures in order to make the igniter element even more versatilely usable. For this purpose, the igniter unit is provided with a choke means in accordance with another suggestion of the invention. This choke means can be, for instance, cemented, threaded, or connected by a bayonet connection to the external housing. This choke means is preferably detachably connected to the external housing in order to obtain an exchangeability. For example, this choke means can consist of a cylindrical component, made of a suitable metal or other material capable of withstanding the pressures acting thereon, having an axial bore, which component is inserted into the external housing and which component is arranged at a spacing from the internal housing and acts in the manner of a throttle nozzle. Then another, secondary combustion chamber is formed between the front end of the at least one discharge duct and the throttle nozzle arranged at a distance. It is essential that the throttle nozzle form a supplementary flow resistance but without hindering the emergence of the ignition flame in an undesired manner. Flow behavior and the composition of the gas-particle mixture and thus the characteristic of the ignition flame can be even better adapted to the requirements of the respective individual case by way of the geometrical form and the dimensions of the at least one throughflow opening of the choke means and of the preferably provided secondary combustion chamber.

In accordance with one embodiment of the invention, the choke means between the internal housing and the propellant charge is simultaneously formed as a holding element for the internal housing in that the choke means is positioned to contact, for example, directly on the front end face of the internal housing and in that way fixes the internal housing in position in the external housing. Then the internal housing itself is preferably inserted loosely into the external housing. A suitable cutout in the internal housing and/or in the choke means is provided for the connection between the front end of the discharge duct and the rear end of the throughflow opening of the choke means, in case this is necessary. A detachable connection of the choke means to the external housing as well as the loose insertion of the internal housing into said external housing allow changes in the flow velocity of the cloud of gas produced by ignition as well as changes in the mixing proportions between hot particles and gas by the selection of another choke means or even another internal housing.

In a choke means simultaneously locking the internal housing in the external housing, it is also contemplated to provide for the formation of the secondary combustion chamber by equipping the internal housing and/or the choke means with a recess of appropriate size in the area of their mutually facing end faces, in which recess afterburning takes place. Thus, even in a comparatively slow-burning booster charge it can be ensured, for instance, that no or only few unburned particles flow through the choke means to the outside. If, for example, the flow resistance of the choke means is great compared to that of the opening in the vicinity of the rear end of the internal housing and compared to that of the discharge duct, so that the choke means constitutes the larger portion of the tamping, then the burning occurs in the primary combustion chamber, in the discharge duct, and in the preferably still provided secondary combustion chamber at relatively high pressure and correspondingly rapidly. In contrast, if an essential choking of the cloud of gas resulting from ignition already occurs in the opening and in the discharge duct, then the pressure here and in the secondary combustion chamber if lower than in the above-mentioned case, which results in a correspondingly slower reaction of the booster charge. The temporal process of the ignition pressure, i.e. the acuteness of the ignition, and the composition of the cloud of gas produced by ignition can therefore also be definedly varied in that the flow resistance along the path of the cloud of gas resulting from ignition is determined differently within the igniter element in a predetermined manner. In this connection, the primary and secondary combustion chambers form, so to speak, a high pressure chamber and a low pressure chamber, the pressure level of which is determinable by an appropriate design of the respective flow cross-sections.

Embodiments of the invention are shown in the accompanying drawings and are described in more detail in the following detailed description with reference to the drawings, wherein:

FIG. 1 shows an igniter unit or assembly having the igniter element with booster charge of this invention in longitudinal section;

FIG. 1*a* shows a cross-section along line I—I in FIG. 1;

Figure 1:
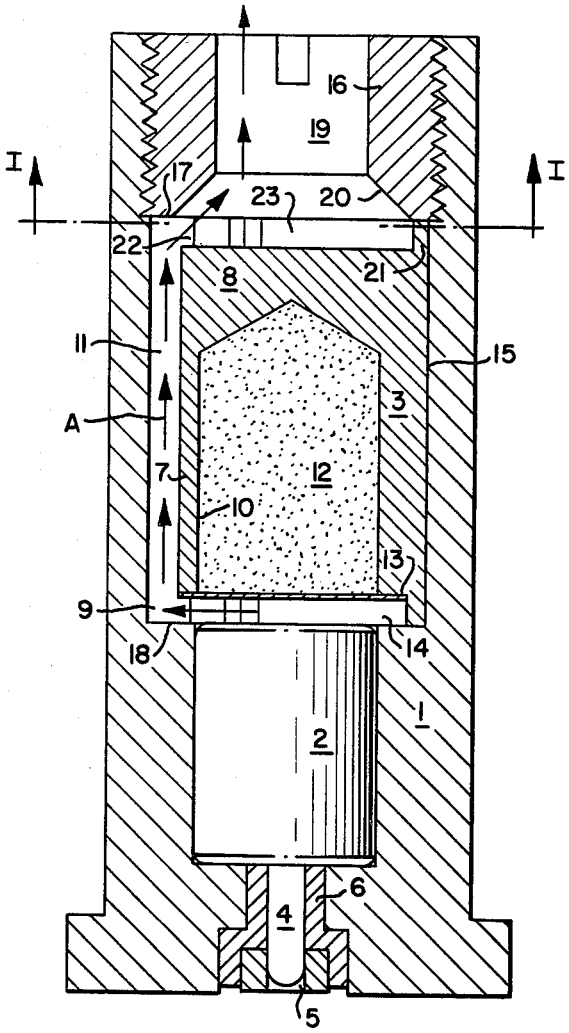

According to FIG. 1, in the igniter assembly shown, the igniter element 2 formed, e.g. as disclosed in U.S. Pat. No. 3,763,782, is pressed into an external housing 1 from the rear end into the recess provided therefor with a press seat. Subsequently, an internal housing 3, e.g. with a sliding seat or also a slight press seat, is placed from the front end into the external housing 1. The external housing and the internal housing are made of any material withstanding the internal pressure and also the pressure exerted by the powder charge. Examples of suitable materials are brass, aluminum, a ceramic material, as well as glass-, quartz, or carbon-reinforced epoxy resins. As shown the igniter element 2 is capable of being triggered electrically, but it could also be capable of being initiated mechanically. The current supply takes place via the external housing 1 and via the electrically conductive middle pole 4 as well as via the likewise electrically conductive ring 5, employed for the improvement of the contacting. The ring and the middle pole 4 are electrically insulated from the external housing 1 with the aid of the sleeve 6. The internal housing 3 has a closed lateral wall 7 and a closed base 8 on its front end. The wall 7 and the base 8 are integrally formed in such a way that they withstand maximum ignition pressure, i.e. do not rip open or break open during ignition. In the rear end of the internal housing 3, three radial openings or passages, uniformly distributed over the periphery, are provided in the wall 7. These openings 9, which can be also seen in the embodiment of FIG. 3, connect the recess 10, which proceeds from the rear end of the internal housing 3 and which is like a blind-end bore, to the three axially oriented discharge ducts 11.

The booster charge 12 is placed into the recess 10, preferably it is pressed into place. With respect to this charge, a plurality of variations is possible especially regarding the type and character of the booster charge. For example, the booster charge can contain gunpowder, nitrocellulose powder or other substances. As shown, the booster charge is a particulate mass that consists of a chlorate-free and perchlorate-free thermal mixture made up of inorganic oxidation and reduction agents according to German Pat. No. 1,171,321 (and corresponding British Specification No. 1,065,244), made up of nitrocellulose or of a mixture of boron and potassium nitrate. The booster charge 12 is rearwardly sealed off with the aid of a cover 13 of e.g. metal foil, powder foil, or paper, which cover is destructible or ignitable by the primary igniting flame of the igniter element 2.

The primary combustion chamber 14 is provided between the igniter element 2 and the cover 13, located at a spacing from said igniter element, which combustion chamber becomes larger with increasing reaction of the booster charge 12. The lateral openings 9 of the internal housing are joined to the front end of the external housing 1 by way of the three axial discharge ducts 11. The discharge ducts are formed as longitudinal grooves in the outer wall of the internal housing 3. They are outwardly defined—seen in cross-section—by the inner wall 15 of the external housing 1.

The internal housing 3 is held in the position shown in the external housing 1 in that the choke means 16 is threaded into the external housing 1 from the front end in such a way that said choke means firmly contacts, with its rear annular end face 17, the three front ring segment surfaces 18 of the internal housing, wherein this internal housing is, in turn, pressed with its three rear ring segment surfaces 18 against a corresponding annular shoulder of the external housing. The choke means 16, as a discharge nozzle, is provided with the central throughflow opening 19 as well as the truncated cone-shaped recess 20 which emanates from the rear end and narrows toward the front. This means may be made of the same type of materials used for the external and internal housings. The internal housing 3 has the annular projection 21 on its front end face, which projection is interrupted by three radial openings 22 which join the discharge ducts 11 to the throughflow opening 19. The recess 20 and the inner chamber defined by the projection 21 together form the secondary combustion chamber 23.

The course of operation during the detonation of the igniter element according to the invention with a booster charge is as follows:

When the igniter element 2 is detonated, then a primary ignition flame first propagates in the primary combustion chamber 14. As a rule, this primary ignition flame is of very brief duration and acute and only capable of igniting the booster charge 12 via destruction of the cover 13. The reaction of the booster charge 12 starts on the surface provided with the cover 13 and, according to the type and the packing, it burns more or less rapidly in the direction of the base 8 of the internal housing 3. The cloud of smoke produced by ingition generally consists of hot gases and hot still-burning or also only glowing particles. However, according to the selection of the type of booster charge and the technical design of the internal and external housings and optionally the choke means for flow and combustion, the cloud of smoke can also consist only of hot gases. The cloud of smoke produces a pressure in the interior 10 of the internal housing 3; this pressure causes the hot gases to be able to emerge from the igniter element and from the igniter unit or assembly as a flame, corresponding to the arrows A from the primary combustion chamber 14, via the openings 9 of the internal housing 3, via the discharge ducts 11, the radial openings 22, the secondary combustion chamber 23, and the throughflow opening 19. By decreasing or enlarging the throughflow opening 19 in the choke means 16 the total internal pressure in the external housing 1 can be increased or decreased as desired and thus—as with the other above-mentioned measures as well—the flow velocity and the composition of the cloud of gas produced by ignition as well as the outer flame geometry, which is significant for the ignition of the propellant powder charge, can be specifically modified.

Figure 1A:
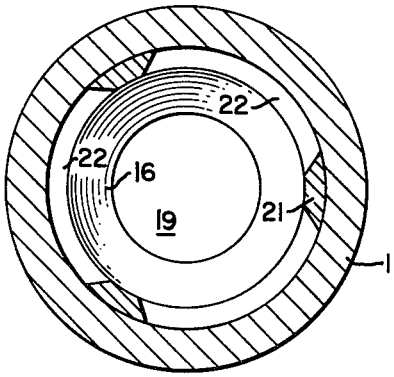

The cross-section of FIG. 1*a* shows the parts left standing of the annular shoulder 21 with the three radial openings 22 formed between them. In the view, the choke means 16 with the throughflow opening 19 can be seen from below.

Figure 2:
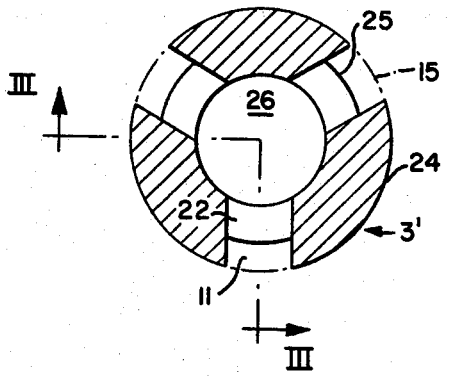
FIG. 2 shows another internal housing for the booster charge in cross-section.
Figure 3:
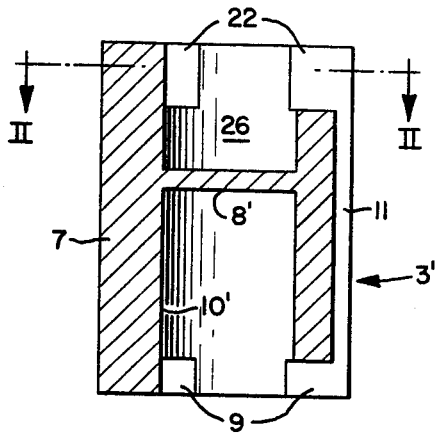
FIG. 3 shows a pertinent longitudinal section of the internal housing shown in FIG. 2.

The embodiment of the internal housing 3', shown in FIG. 2 in cross-section along line II—II of FIG. 3, has, on its outer wall 24, three longitudinal grooves 25 in a symmetrically distributed arrangement; these grooves form, together with the inner wall 15, indicated in dot-dash lines, of the external housing, the axial discharge ducts 11. The discharge ducts 11 are connected at the front end of the internal housing to a recess 26 via the radial, groove-like recesses 22, which recess 26 is part of a secondary combustion chamber.

FIG. 3 shows the same internal housing 3' in section along line III—III in FIG. 2. The recess 10' for receiving the booster charge proceeds from the rear end of the internal housing 3'; the booster charge is sealed off forwardly by the base 8' which withstands the ignition pressure. The additional recess 26 follows the base forwardly to form part of the secondary combustion chamber. In the right-hand half, a discharge duct 11 having radial openings 9 and 22 can be seen. These openings are arranged in the same manner also in case of the internal housing 3 shown in FIG. 1.

Figure 4:
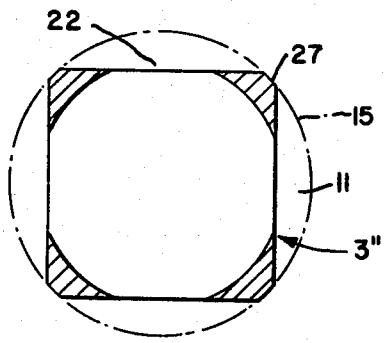
FIGS. 4 and 5, respectively, show another internal housing in cross-section and in longitudinal section.
Figure 5:
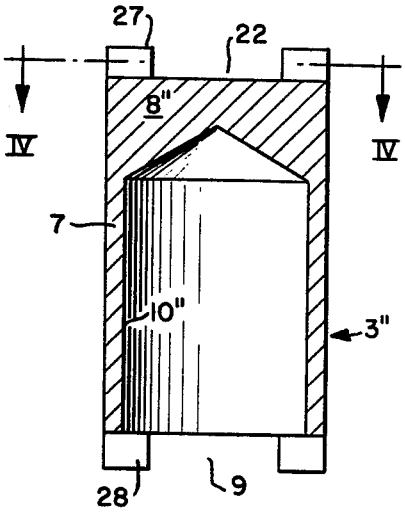

FIG. 4 shows a different internal housing 3'' in cross-section along line IV—IV in FIG. 5. The internal housing 3'' can be very simply manufactured from an extruded element having a square cross-section by finishing to the dimensions of the inner wall 15, indicated in dot-dash lines, of the external housing. The discharge ducts 11 are then formed by the spaces formed between the internal housing 3'' and the external housing. The choke means contacts the four spacer elements 27, integrally formed on the front end, so that the cloud of gas produced by ignition can flow off through the openings 22.

Finally, in FIG. 5 the internal housing 3'' is shown in longitudinal section. The internal housing 3'', provided with the recess 10'', the base 8'', the front spacer elements 27, and the openings 22, has four additional spacer elements 28 on its rear end, between which elements the openings 9 are formed. The spacer elements 27 and 28 have the same form, but these elements can also have differing shapes when necessary.

It will be further recognized that the outer casing of the igniter element 2 constitutes the ground contact together with the outer housing 1. For ignition purposes, the ignition current is conducted via the central pole 4 and the electrically conductive ring 5. Ignition takes place by means of an ignition bridge which represents a resistance, this resistance, by being heated, igniting the initiator charge in the igniter element 2. Such an ignition bridge is described in FIGS. 3*a* and 3*b* of U.S. Pat. No. 3,763,782 (ignition bridge 11).

The igniter element 2 can also be fashioned as a percussion primer.

We claim:

1. An igniter unit for igniting of propellant charges, pyrotechnical mixtures, or the like, which comprises an external housing, an igniter element operatively associated with a booster charge, said igniter element being arranged within one end of the external housing, an internal housing which contains said booster charge and which is within said external housing, said internal housing having a closed, lateral wall and a closed base at one end which is spaced from the igniter element and which is located close to the other end of said external housing, said wall and base withstanding the ignition pressure caused by the generation of a cloud of gas during ignition of said igniter element and said booster charge; in the area of the other end of the internal housing, said internal housing defining at least one opening for permitting the flowing off of the cloud of gas produced by ignition of the igniter element and the booster charge and providing means for choking of said cloud of gas, and means providing at least one discharge duct that connects said at least one opening to the other end of the external housing whereby the cloud of gas is passed via said one opening and said discharge duct to the other end of said external housing.

2. An igniter unit according to claim 1, wherein the discharge duct is formed in the shape of an axially oriented recess in the external housing.

3. An igniter unit according to claim 1 or 2, wherein the other end of said external housing projects beyond the internal housing, and the other end includes an additional choke means having at least one throughflow opening.

4. An igniter unit according to claim 3, wherein the additional choke means is formed as a holding element for the internal housing.

5. An igniter unit according to claim 4, wherein one combustion chamber is formed between the internal housing and the external housing by at least one recess at the mutually facing surfaces of the other end of the internal housing and the one end of said external housing and an additional combustion chamber is formed by at least one recess at the mutually facing surfaces of the one end of the internal housing of the additional choke means.

6. An igniter unit according to claim 1, wherein said lateral wall and said base are integrally formed within said internal housing.

7. An igniter unit according to claim 1, wherein said booster charge is a particulate material compacted within a recess provided in said internal housing.

8. An igniter unit according to claim 7, wherein the recess in said internal housing is provided with an enlarged opening that is directed towards the other end of said internal housing, said enlarged opening being provided with a destructible cover element for retaining the booster charge within said recess.

9. An igniter unit according to claim 8, wherein a primary combustion chamber is provided between the igniter element and the internal housing by at least one projection extending from the one end of said internal housing.

10. An igniter unit according to claim 1, wherein a combustion chamber is formed at the other end of said external housing by at least one projection extending from the one end of said internal housing, said at least one projection defining at least one opening which is in communication with said at least one discharge duct for allowing the cloud of gas to enter into said combustion chamber.

11. An igniter unit according to claim 1, wherein the discharge duct is formed in the shape of an axially oriented recess in the internal housing.

12. An igniter unit according to claim 1, wherein the discharge duct is formed in the shape of an axially oriented recess between the external and internal housings.

13. An igniter unit according to claim 1, wherein the igniter element is arranged in tandem with said booster charge and the one end of said external housing is closed and the other end of said external housing is open to allow the discharge of the cloud of gas produced by ignition of the igniter element and the booster charge.

14. An igniter unit according to claim 1, further comprising an additional choke means arranged at the other end of said external housing, said igniter element, said booster charge and said additional choke means being arranged axially within said external housing, said internal housing defining a recess which faces away from the one end of said internal housing, said recess containing said booster charge, whereby said booster charge is arranged opposite to said igniter element.

* * * * *